US007540813B2

(12) United States Patent
Liberatore

(10) Patent No.: US 7,540,813 B2
(45) **Date of Patent: *Jun. 2, 2009**

(54) RETENTION OF WEIGHTING ON AN ATHLETIC STRIKER

(76) Inventor: Raymond A. Liberatore, 12143 Punkin Hollow Rd., Bentonville, AR (US) 72712

( * ) Notice: Subject to any disclaimer, the term of this patent is extended or adjusted under 35 U.S.C. 154(b) by 0 days.

This patent is subject to a terminal disclaimer.

(21) Appl. No.: 11/610,501

(22) Filed: Dec. 13, 2006

(65) Prior Publication Data

US 2007/0123371 A1 May 31, 2007

Related U.S. Application Data

(63) Continuation of application No. 10/761,132, filed on Jan. 20, 2004, now abandoned, which is a continuation-in-part of application No. 10/262,734, filed on Oct. 1, 2002, now abandoned.

(51) Int. Cl.
*A63B 69/00* (2006.01)

(52) U.S. Cl. ..... 473/457; 473/422; 473/437

(58) Field of Classification Search ..... 473/422, 473/437, 457, 519, 520, 558–568, 256, 231; 482/105–109, 93, 94, 98, 140, 34
See application file for complete search history.

(56) References Cited

U.S. PATENT DOCUMENTS 1,026,990 A 5/1912 Matson
2,676,803 A 4/1954 Damaske
2,737,394 A * 3/1956 Abel ..... 473/256
3,521,883 A 7/1970 Hamilton
3,593,769 A 7/1971 Spears
3,606,327 A 9/1971 Gorman
3,623,724 A 11/1971 Lande
4,000,893 A 1/1977 Evans
4,588,191 A 5/1986 Stewart
4,621,808 A 11/1986 Orchard et al.
4,671,510 A 6/1987 Schoenwetter
4,842,280 A 6/1989 Hilton
5,050,877 A 9/1991 Wales
5,403,009 A 4/1995 Gleason, Jr.
5,484,156 A 1/1996 Giguere
5,888,154 A 3/1999 Hartman
5,980,397 A 11/1999 Hart et al.
6,007,461 A * 12/1999 Winston ..... 482/55
6,010,415 A 1/2000 Miggins
6,093,114 A 7/2000 Haringa
6,102,810 A 8/2000 Boland
6,419,591 B1 7/2002 Addeo et al.
6,533,685 B1 3/2003 Otten et al.
6,739,989 B2 5/2004 Liberatore
6,939,273 B2 * 9/2005 Zajac et al. ..... 482/93

* cited by examiner

*Primary Examiner*—Mitra Aryanpour
(74) *Attorney, Agent, or Firm*—Myers Wolin, LLC

(57) ABSTRACT

Apparatus to add weight to an athletic ball striking bat, having a taper along the bat length, comprising in combination a sleeve sized to extend about the bat at the taper location, the sleeve having associated retention means to engage the bat at a zone along said taper to resist lengthwise removal of the sleeve off the bat during bat swinging, a weight or weights carried by the sleeve.

17 Claims, 10 Drawing Sheets

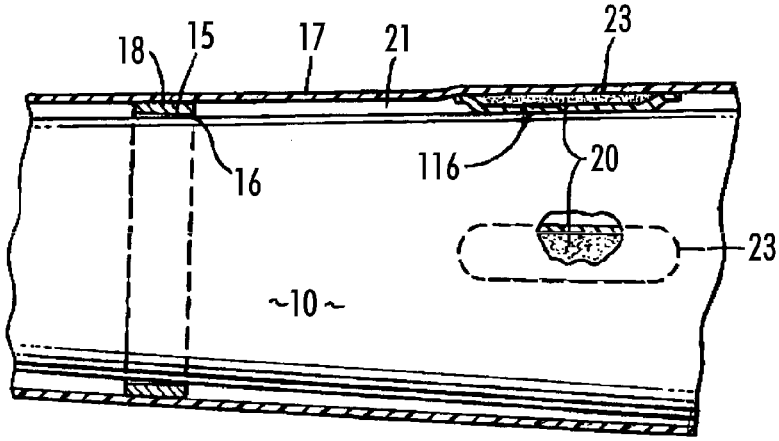
FIG. 14
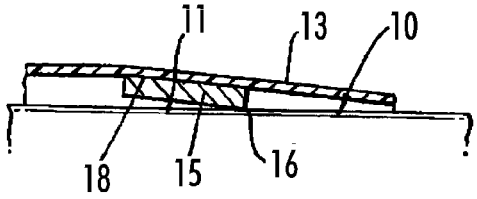
FIG. 15
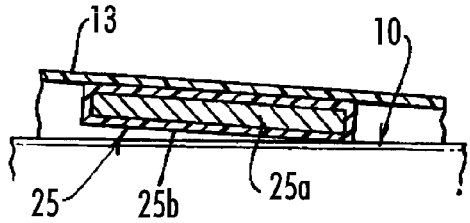
FIG. 16
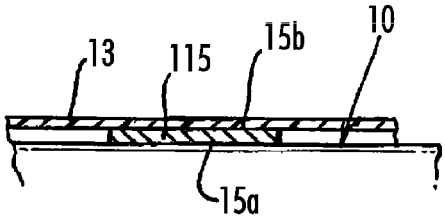
FIG. 17
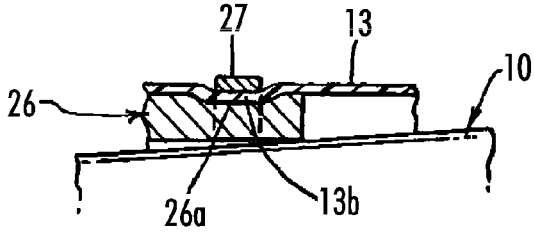
FIG. 18
FIG. 19
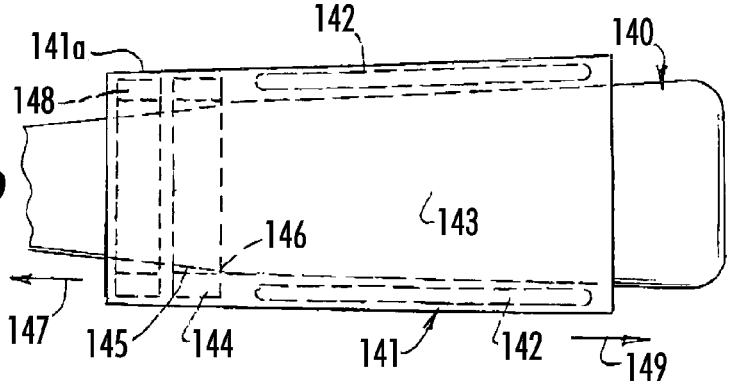

RETENTION OF WEIGHTING ON AN ATHLETIC STRIKER

CLAIM OF PRIORITY

This application is a continuation of Ser. No. 10/761,132, filed Jan. 20, 2004 now abandoned, which is a continuation-in-part of Ser. No. 10/262,734 filed Oct. 1, 2002, now abandoned, both of which are incorporated herein by reference in their entireties.

FIELD OF THE INVENTION

This invention relates generally to swinging of ball strikers as, for example, baseball bats. More specifically, it is related to the field of practice or warm-up swinging of such strikers or bats having weight added to them.

BACKGROUND OF THE INVENTION

When athletes who handle ball strikers warm-up, or train, they commonly use two strikers, and swing them in unison a few times to loosen muscles. Holding and swinging two strikers is awkward, uncomfortable, and does not achieve the right feel, needed as by gripping and swinging only one striker but one striker does not achieve additional weight as can be provided by two strikers. There is need to overcome this dilemma, in a simple, effective and efficient manner, as is now provided by the present invention. In a similar manner, there is need to provide improvements in devices for adding weight to ball strikers such as baseball bats, for example.

There is also need for a weight holding device that can be easily attached to and removed from a bat and which positively and safely retains the added weight to the bat.

SUMMARY OF THE INVENTION

It is a major object of the invention to provide a simple and effective device or apparatus that meets the above need. Basically, the device is adapted for use in a ball striker or bat having a taper or tapered surface, along its length, and includes:

a) a sleeve sized to extend about the bat at the taper location;

b) the sleeve having associated retention means to operatively engage the bat in a zone along said taper to resist lengthwise removal of the sleeve off the bat during bat swinging, c) a weight or weights carried by the sleeve.

As will be seen, the weight or weights are typically carried at a location or locations proximate to the ball striking zone; and the retention means is spaced from the weight or weights, and has an arcuate interior surface to arcuately engage the bat at arcuately spaced locations.

It is a further object to enable bat reception through the sleeve, so that the bat handle projects from the sleeve, the engaged zone of the bat typically located between the handle and weight or weights. The latter may be located in a pocket or pockets formed by or attached to the sleeve.

An added object is to provide the retention means to include a retainer at the inner side of the sleeve, and which has an inner surface to engage the bat taper, such inner surface having a configuration defined by one of the following:

i) generally cylindrical ii) tapered, lengthwise of the sleeve

A yet further object it to provide a first pulling device on the sleeve to enable manual pulling of the sleeve endwise along the bat during close fitting assembly of the sleeve to the bat. A second pulling device may be provided on the sleeve to enable manual pulling of the sleeve endwise along and off the bat. Such devices may comprise pullers such as loops projecting at the sleeve exterior.

Another object is to provide the weight or weights to comprise a deformable mass or masses of surface configuration, at or proximate the bat "Sweet spot".

An added object is to provide a retainer having an inner surface characterized by at least one of the following:

i) conical shape ii) tapered iii) cylindrical iv) consisting of metal v) consisting of non-metal vi) consisting of plastic Another aspect of the invention concerns provision of a method of use of the sleeve as described, in any of its forms, that includes i) relatively advancing the sleeve in a first direction onto the bat to position the associated retention means at or along the bat taper;

ii) practice swinging the bat, iii) and subsequently relatively retracting the sleeve off the bat in second direction opposite the first direction.

That method may include use of deformable weight or weights carried by the sleeve in spaced relation to the retainer, as well as the step of allowing said weight or weights to deform during bat swinging.

It is still a further object of the present invention to provide a bat weight which includes free flowing weighted materials such as shot, steel balls, bead, beans and sand.

It is a further object of the present invention to provide a bat weight which can accommodate a plurality of bats having a plurality of widths and diameters.

These and other objects and advantages of the invention, as well as the details of an illustrative embodiment, will be more fully understood from the following specification and drawings, in which;

DESCRIPTION OF THE DRAWINGS

FIG. 14 is a section taken through a sleeve assembled to a bat, and showing retainer and weight positioning;

FIG. 15 is an enlarged view of the retainer seen in FIG. 14;

FIG. 16 is an enlarged view of a modified retainer of the type shown in FIG. 15;

FIG. 17 is a view like FIG. 15, but showing a conical retainer; and

FIG. 18 is a view showing a modified form of sleeve attachment retainers and FIG. 19 is a view of a modified sleeve, retainer and weight structure;

DETAILED DESCRIPTION

Figure 1:
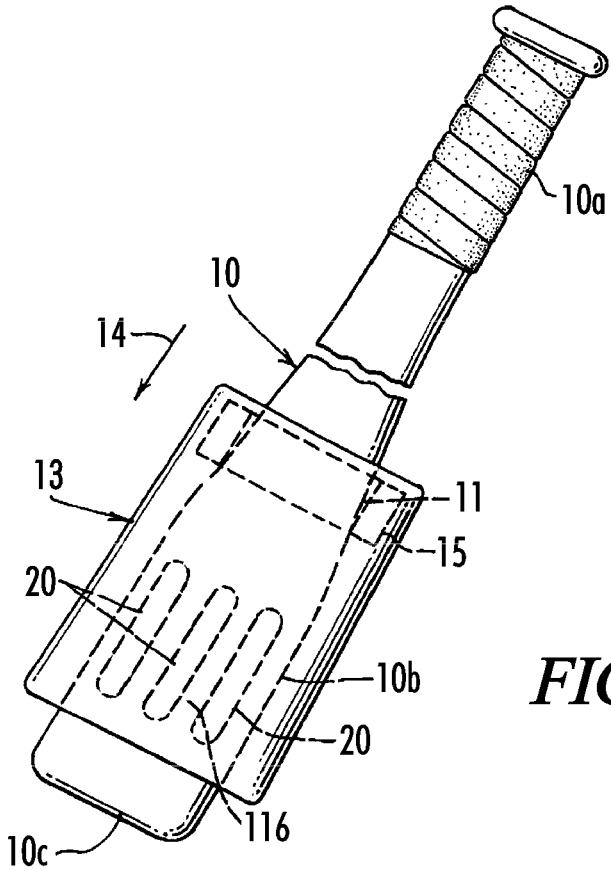
FIG. 1 is a front side elevation showing an elongated sleeve-type receptacle receiving a ball striker such as a baseball bat.

Referring to FIG. 1, an athletic ball striker, in the form of a bat 10 has a surface taper along its length, in region 11. That taper may he defined by a conical section of the bat, between handle 10*a*, and the bat sweet spot or region 10*b*. The forward end of the bat is seen at 10*c*.

A sleeve 13 is provided and sized to be received endwise on the bat, in direction 14. As shown, its assembly onto the bat is arrested in the sleeve position shown, extending about taper region 11, as well as about the sweet spot region 10*b*. The sleeve may, for example, consist of flexible plastic material.

The sleeve has associated retainer means to engage the bat, at taper region 11, and to resist lengthwise removal of the sleeve off the bat, in direction 14. That retainer means may take the form of an annular retainer ring indicated at 15, FIGS. 14 and 15 show the retainer engaging the bat tapered surface, at 16, with interference, to resist further forward movement along the bat. The sleeve 17 is attached to the retainer, or carries the retainer as at 18, so that the sleeve is likewise retained against further forward movement on and along the bat. The attachment 18 may be a bond, or the retainer may be mechanically attached to the sleeve, as by a fastener or fasteners. Sleeve material may extend between the retainer and the bat.

Retainer 115 is shown in FIG. 17 as generally conical, and as having conical inner and outer surfaces 15*a* and 15*b*, FIG. 16 shows the modified retainer 25 as comprising an annular ring 25*a* and having a coating 25*b* on it, such as a plastic coating, serving to engage the 10 bat surface without scoring it. FIG. 18 shows a retainer 26 in the form of a ring, and having an annular recess 26*a*. A clamping ring 27 extends about recess 26*a*, and clamps a portion 13*b* of the sleeve into the recess, to secure the sleeve to the retainer 26.

The sleeve 13 FIGS. 1 and 14 carries a weight or weights 20, spaced forwardly of the retainer 15 at location 116. See space 21 in FIG. 14. That space may be of selected length, and may be almost eliminated to place the weights very near the retainer; however, as shown, the retainer 15 is located between location 116 and the bat handle. That weight or weights may consist of a mass of deformable material such as metallic granules contained in a pocket or pockets 23 (see in FIG. 14) integral with the sleeve. Such pockets hold the granules in close conformity to the bat surface at location 116, and the pockets may themselves be flexible to enhance such conformity, so that the bat overall configuration remains generally the same, whether or not the sleeve is applied and retained. This may be promoted by forming the pockets in elongated, narrow configuration, and spaced about the bat as indicated by the weight locations seen in FIG. 1. The weights are preferably located adjacent region 116. The pockets may be sewn to the sleeve.

Figure 2:
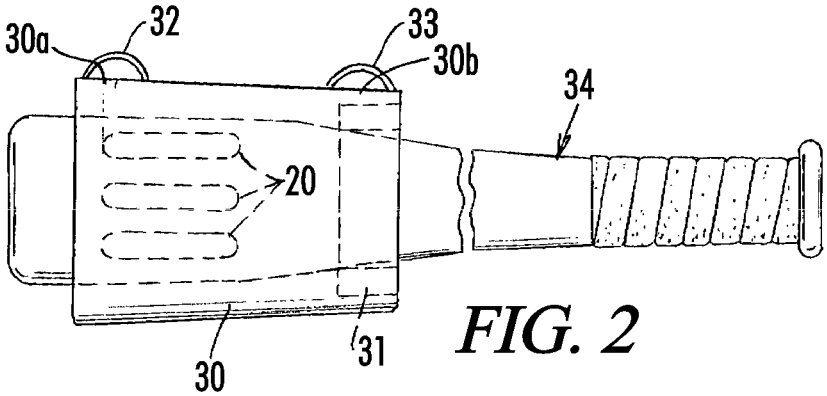
FIG. 2 is a view like FIG. 1 showing a modification.
Figure 4:
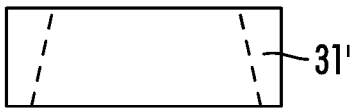
FIGS. 3 and 4 are side views of two types of retainers usable in the sleeve of FIGS. 1 and 2.
Figure 3:
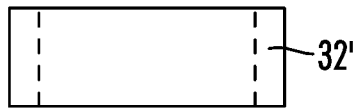

FIG. 2 shows a sleeve 30 received on bat, and held against forward dislodgement by annular retainer 31. A first device, such as loop 32 is provided on or attached to the sleeve forward side portion 30*a*, for enabling manual pulling of the sleeve forwardly along the bat during assembly. A second device, such as loop 33, is provided on or attached to the sleeve rearward side portion 30*b*, for enabling manual pulling of the sleeve rearwardly along the bat, during disassembly off the bat 34. FIG. 4 shows the conical retainer 31', similar to 115 and FIG. 3 shows a modified retainer 32', in the form of a cylinder, similar to 15.

Figure 5:
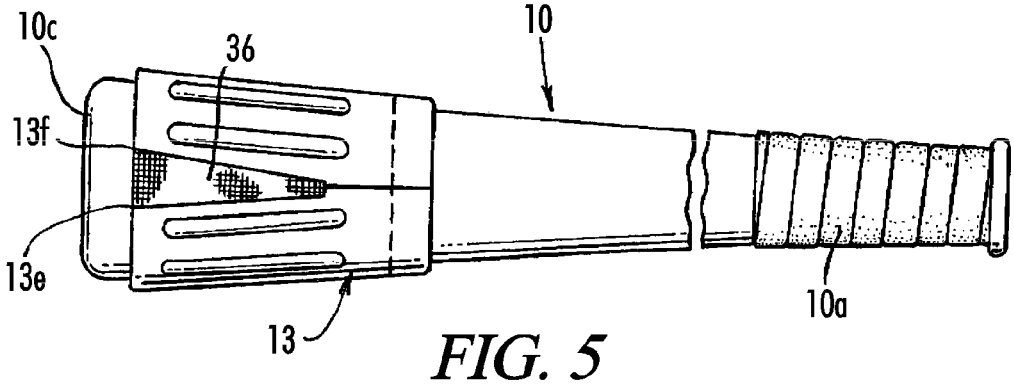
FIG. 5 is a view like FIG. 1, showing another modification.
Figure 6:
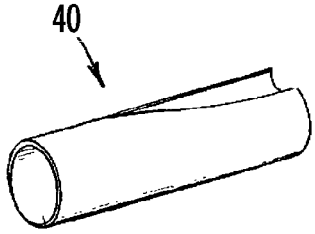
FIGS. 6-9 are three-dimensional views of further modifications.
Figure 7:
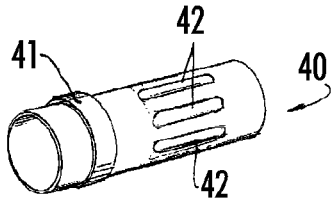
Figure 8:
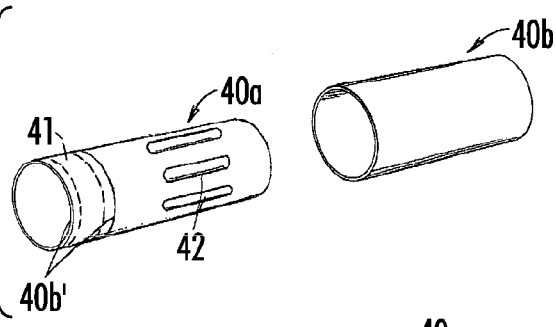
Figure 8A:
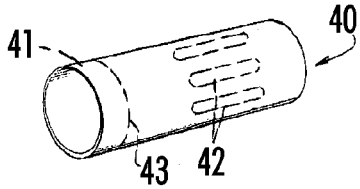

FIG. 5 is a view similar to FIG. 1. The sleeve 13 is split at V-shaped edges 13*e* and 13*f* that extend lengthwise and form a triangle, Stretchable resilient fabric or material such as SPANDEX (elastic synthetic fabric) is provided at 36, and attached to the sleeve along the triangular edges of the sleeve split, of selected length. This allows the sleeve to resiliently expand, for reception on a larger diameter bat, and to fit or adjust to a range of bat diameter sizes.

FIGS. 6, 7, 8 and 8*a* schematically show multiple sections 40*a* and 40*b* of a sleeve assembly 40. Inner sleeve 40*a* carries an annular retainer at 41 and weights at 42. Outer section 40*b* fits telescopically over section 40*a*, to form the assembly 40. An end portion 40*b'* of 40*b* may be pulled back over the retainer 41 and sewn in position at 43.

Figure 9:
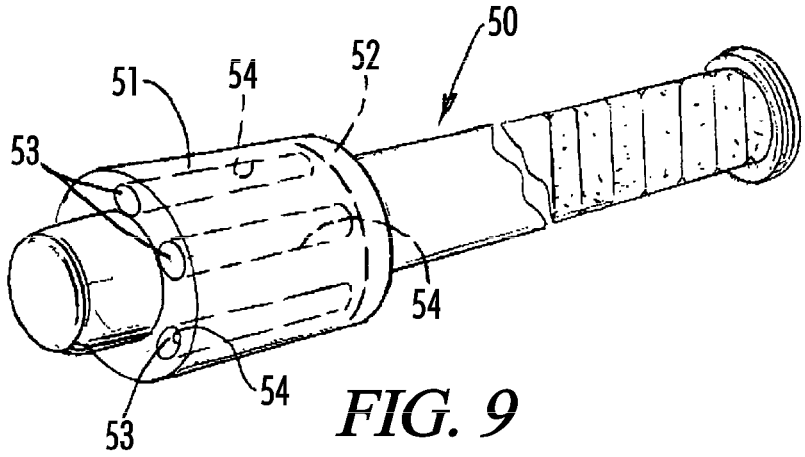

FIG. 9 shows a bat 50, with a thickened sleeve 51 fitting over the bat sweet spot region. A retainer 52 is attached to the sleeve at its end, and may be attached as during molding of the sleeve, as for example if it is made of rubber or plastic. Solid metallic weights 53 fit into pockets 54 in the sleeve itself.

Figure 10:
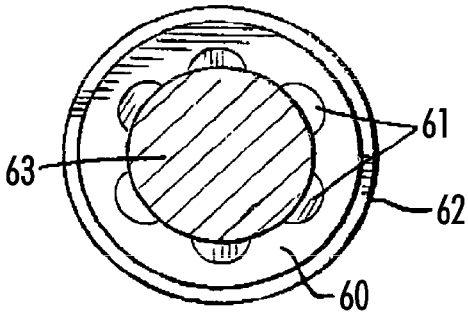
FIG. 10 is a section taken through a modification having inner, outer and intermediate sleeve construction.
Figure 11:
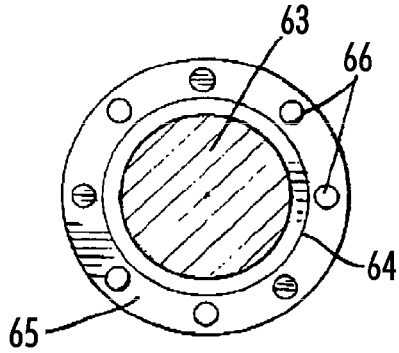
FIG. 11 is a section taken through a modification having inner and outer sleeve construction.

FIG. 10 is a cross section that shows an inner sleeve 60 fitting on a bat and carrying weights at 61; and an outer sleeve 62 fitting over the inner sleeve. The bat is shown in cross section at 63. FIG. 11 shows an inner sleeve 64 fitting on a bat, and an outer sleeve 65 fitting over sleeve 64 and carrying weights at 66. The weights may be carried in pockets in the sleeves. The sleeve carrying the weights may be firm, and the sleeve not carrying weights may be flexible.

Figure 12:
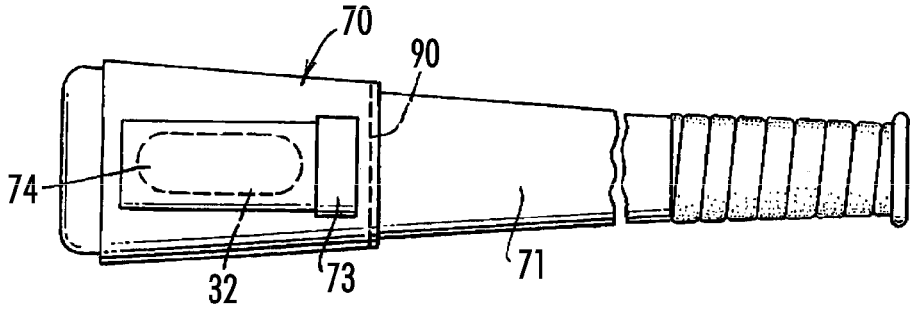
FIGS. 12 and 13 are side views of modifications having different weight position.
Figure 13:
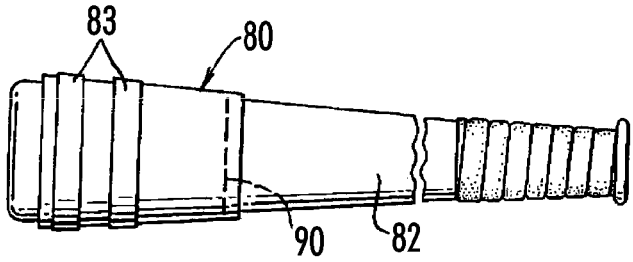

FIG. 12 shows a sleeve 70 on a bat 71, and removable weights 32 carried in pockets 74 that can be opened and closed, as via a flap 73. FIG. 13 shows a sleeve 80 on a bat 82, with weights 83 extending about, or annularly about the bat axis, and carried by the sleeve. See retainers at 90 in FIGS. 12 and 13.

In FIG. 19, bat 140 extends through sleeve 141. Weights 142 are carried by the sleeve as shown, and are spaced about the sleeve axis 143. An annular metallic retainer 144 is carried by the sleeve, and engages the bat tapered surface 145, at annular edge locus 146, to return the sleeve to the bat as during practice swinging. The bat handle extends in direction 147.

Sleeve material 141*a* extends leftwardly beyond the retainer. An insert ring 148 of material is located leftwardly of the retainer, inwardly of material 141*a*, Ring 148 may consist of plastic, and acts as a spacer to keep sleeve end material 141*a* from caving in, or bunching, toward the bat, to interfere with bat separation from the sleeve in direction 149. The sleeve and its and material may be flexible. Ring 148 is typically carried by the sleeve.

Figure 20:
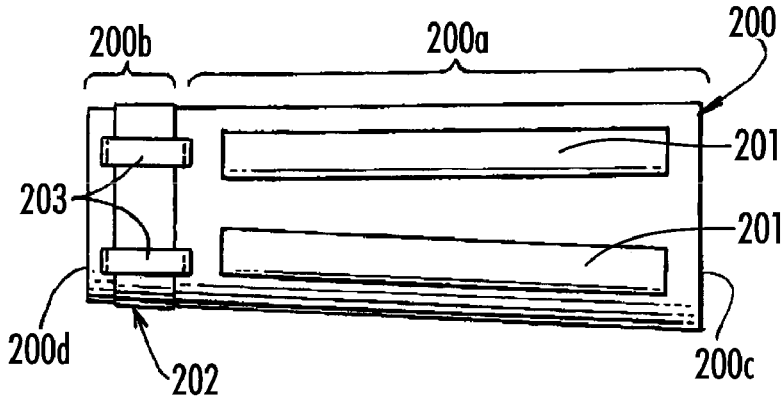
FIGS. 20-27 show modification.

In the FIG. 20 modification, the elements include a sleeve 200 with open ends at 200*c* and 200*d*, weights 201 carried by the sleeve, and spaced about the sleeve at selected positions. The weights can be solid, or flowable in plastic or fabric bags secured to an inner portion of the sleeve. A ring shaped retainer 202 constructed from any material, or coated with vinyl or rubber, extends about the sleeve near sleeve smaller end 200*d*, to retain the sleeve to the bat, which enters at end

200*c*. Retainer straps 203 extend crosswise over the retainer, and may be sewed to the sleeve, to position the retainer and hold it in position. Sleeve portion 200*a* has a greater diameter than sleeve portion 200*b*.

Figure 21:
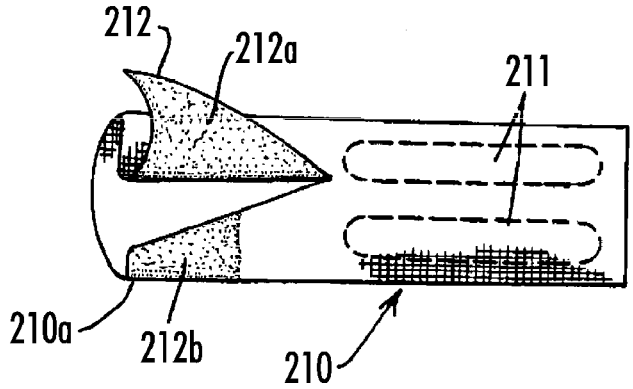

Referring to the embodiment of FIG. 21, the unit comprises a sleeve 210, weights 211 carried by the sleeve, as in FIG. 20, a flap 212 carrying VELCRO 212*a* (hook or pile), and sleeve portion 210*a* carrying a VELCRO 212*b* (pile or hook) to receive adjustable attachment to VELCRO 212*a*. The attachment 212*a* controls the size of the sleeve end portion 210*a* that extends closely about the bat, i.e. is retained to the bat, to retain the sleeve and weights to the bat.

Figure 22:
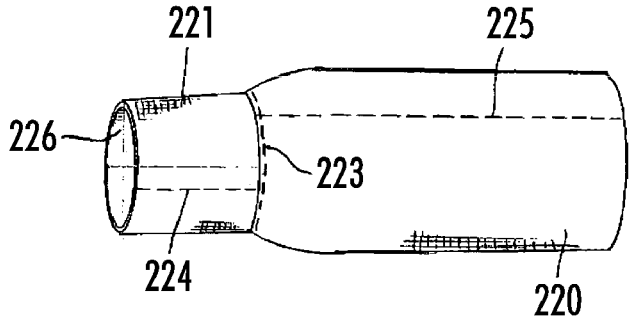
Figure 23:
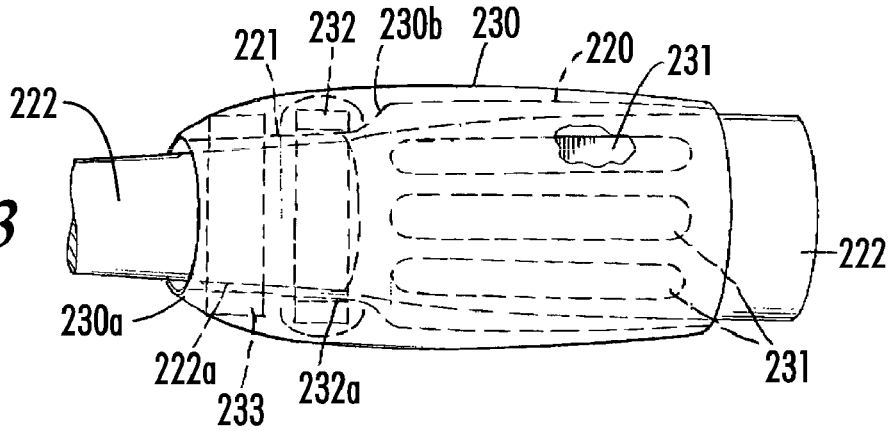

The embodiment of FIG. 22 has the following elements: An inner sleeve section 220 of larger diameter to fit various sizes of bat diameters; an inner sleeve section 221 of smaller diameter, to fit over a bat 222, a narrower section 222*a* as seen in FIG. 23; and sewn together end junctions 223 of 220 and 221. See also the sew lines 224 and 225 sleeve end opening 226.

The embodiment of FIG. 23 has the following elements: an outer sleeve 230 that fits over inner sleeve 220, weights 231 associated with the sleeve, and carried by Annular retainer 232, Retainer 232 is carried by inner sleeve 202 and has inside wall 232*a*. The Retainer can be secured by a fabric piece sewn to inner wall of sleeve. A ring of stiff foam 233 or other material acts as a spacer or positioner for an excess fabric end and sleeve inside wall 230*b*.

Figure 24:
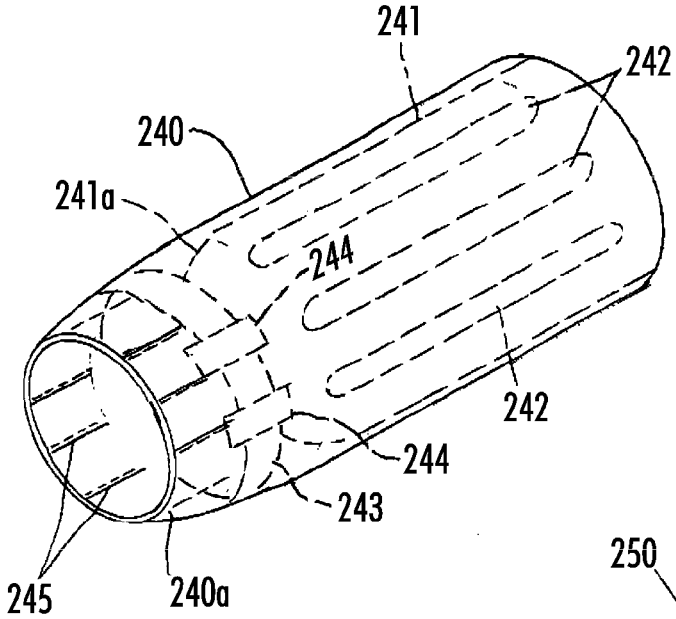

FIG. 24 illustrates yet another embodiment. This embodiment shows the following elements: outer wall sleeve 240; an inner sleeve 241, with larger diameter section 241*a*; weights 242 carried by 240 or 241; ring shaped retainer 243; and straps 244 sewn over the retainer, and onto either sleeve, to position the retainer 243. Finally, outer sleeve end slits 245, sewn together to narrow the sleeve end 240*a*, effectively taper the sleeve to fit a bat taper.

Figure 25:
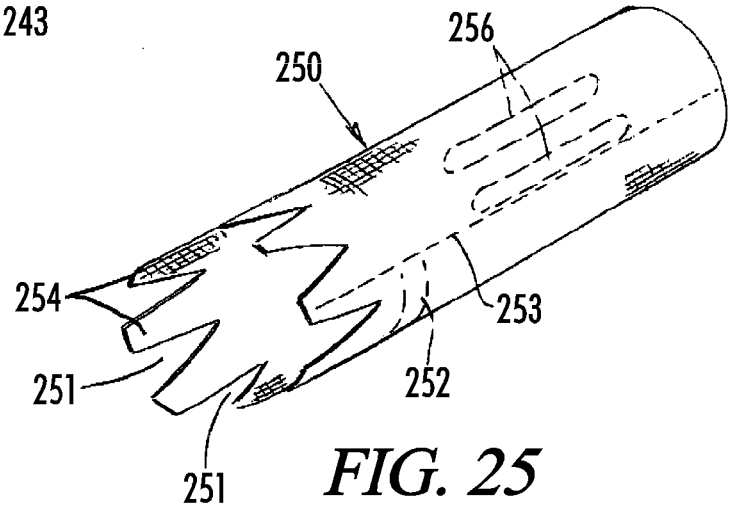
Figure 26:
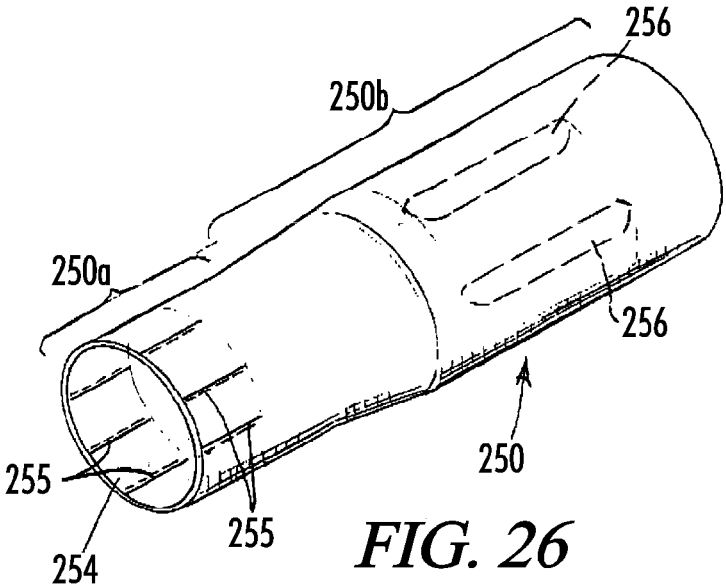

FIG. 25 has the following elements: fabric sleeve 250; cut-outs 251 at one and of 250, which eliminate excess fabric in the retainer are at 252; a sew line 253 at sleeve 250; and sleeve end flaps 254, between cut-outs, to be sewn together as shown in FIG. 26.

FIG. 26 has the following elements associated with FIG. 25: sewn together edges 255 of flaps 254, to provide a reduced diameter sleeve section 250*a* versus the larger diameter sleeve section 250*b*, so that the unit may fit many different size bat barrels; and weights 256.

Figure 27:
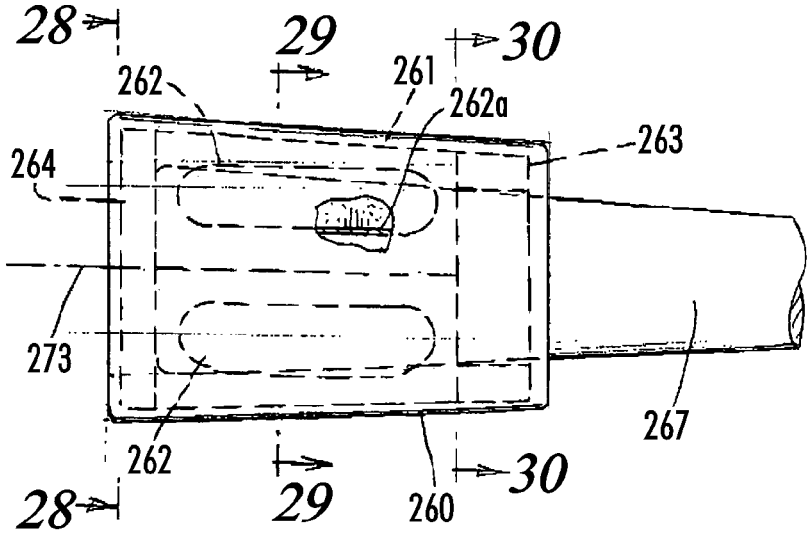

FIG. 27 discloses an embodiment having the following elements: an open end sleeve or outer sleeve 260 that fits onto a bat 267; frame 261 (plastic or metal) associated with or carried by sleeve 260, to extend about inserted bat; weights 262 carried by the frame in pockets 262*a* and spaced about the bat; a sleeve retainer 263 that extends about the bat, to endwise position the sleeve and frame on the tapered bat, as described above; a frame ring 264, including an inside wall 264*a*; an open area 265; and a foam or added plastic sleeve 266.

Figure 28:
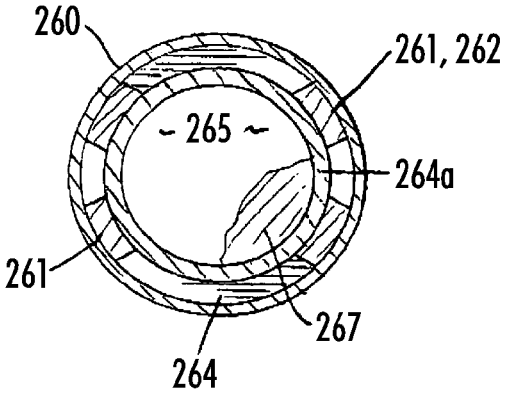
FIGS. 28, 29 and 30 are sections taken on lines 28-28, 29-29 and 30-30 in FIG. 27.
Figure 29:
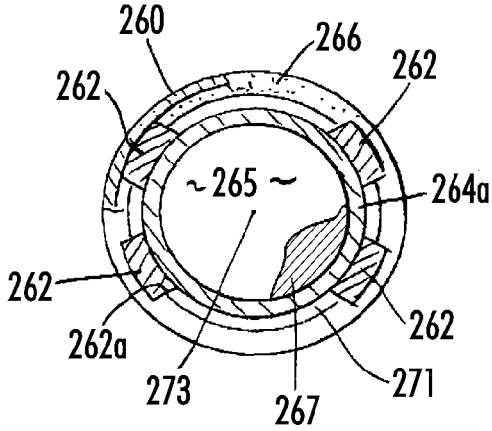
Figure 30:
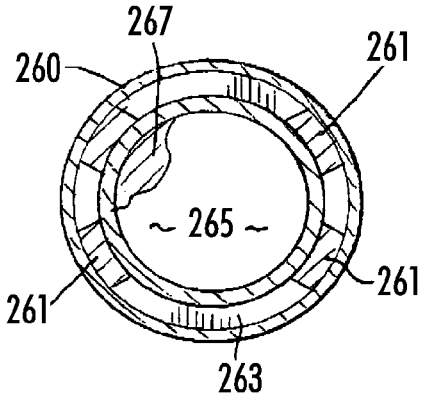

FIGS. 28-30 are section views, taken relative to FIG. 27 and show the positions of weight 262 relative to the frame members. Zone 271 can be an additional plastic sleeve, extending about the frame. Also, the weight pockets can be spaced about the axis 273, between frame members.

Figure 31:
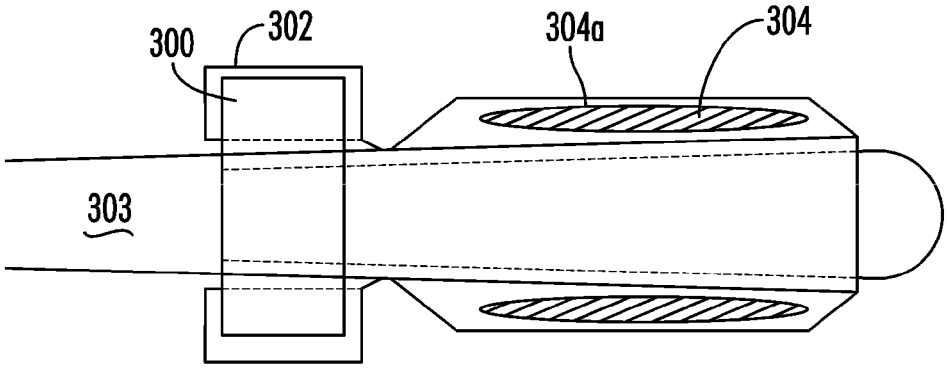
FIG. 31 is an alternative embodiment of the present invention.

Referring now to FIGS. 31 to 34, further alternative embodiments of the invention are now shown. Referring to FIG. 31, an alternative embodiment comprises a foam or rubber coated retainer 300 inside a fabric 302. Second separated weighted member 304 is affixed to the first member and extends longitudinally 304*a* further down the shaft of the bat when in use. The weighted members 304 can comprise solid, loose or flowable material. Non-exclusive examples of flowable materials may comprise materials such as steel or metallic balls or shot, pellets, beans, bird seed, sand and the like. The rubber coated retainer 300 is sewn to the knob end 303 of the fabric 302 to help retain the device in place when in use.

Figure 32:
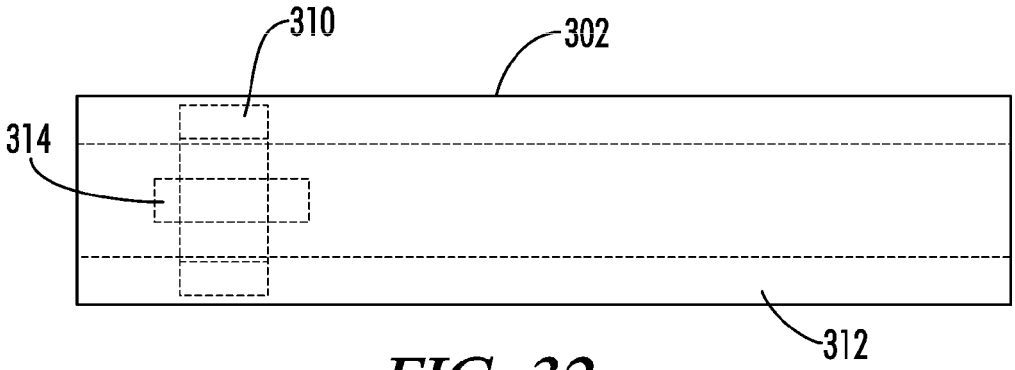
FIG. 32 is yet another embodiment of the present invention.
Figure 32A:
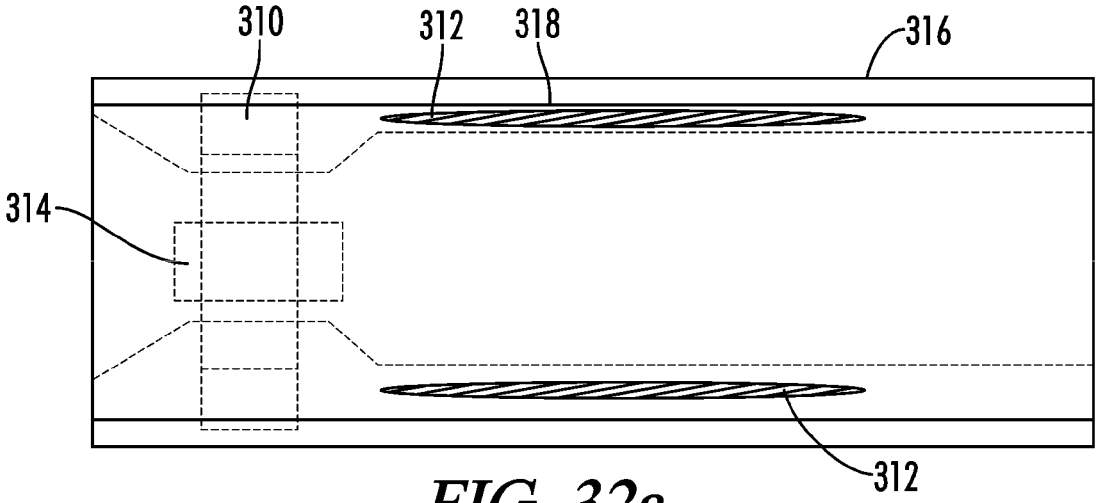
FIG. 32*a* is the complete embodiment of FIG. 32.
Figure 33A:
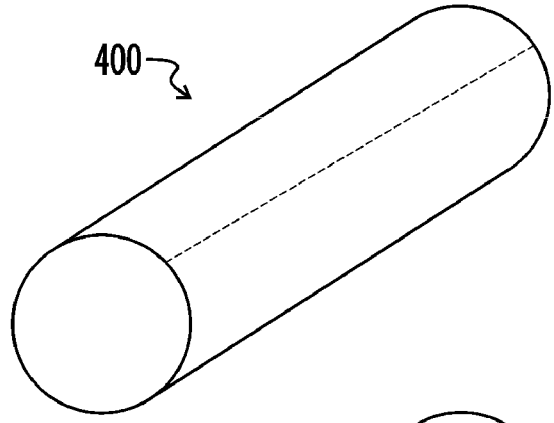
FIGS. 33*a* to 33*e* illustrates the method steps of making the implement. of the present invention.
Figure 33B:
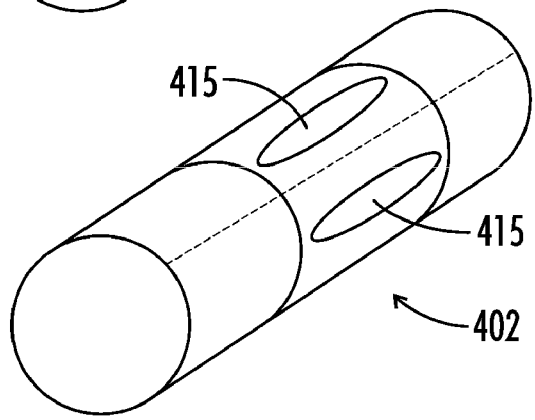
Figure 33C:
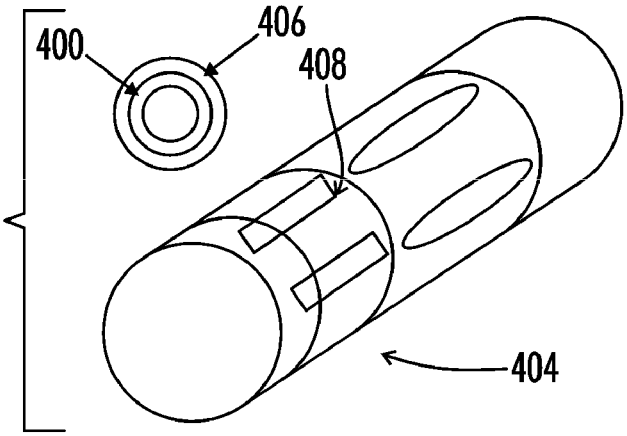
Figure 33D:
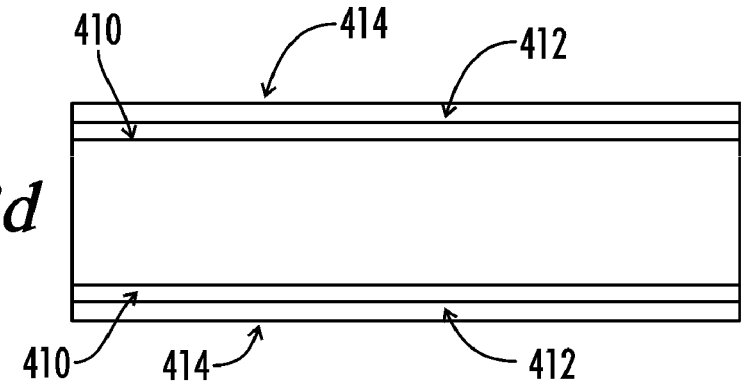
Figure 33E:
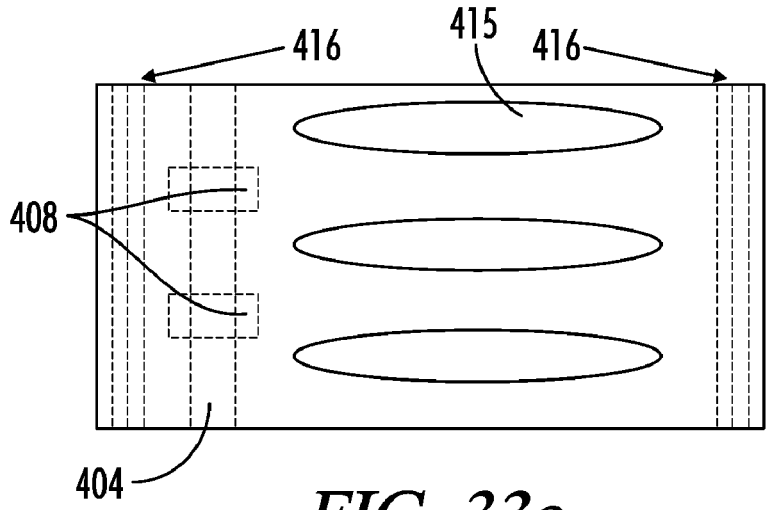

In the embodiment of FIGS. 32 and 32*a*, a further alternative the invention comprises a rubber coated retainer 310 in contact with a weighted material 312. The weighted material 312 is placed in a cavity and comprises a flowable material such as steel balls, pellets, beans, peas and birdseed.

One or more transverse straps 314 are attached in a direction parallel to the longitudinal direction of the bat. The weight may have a fabric or polymeric outer surface 316. Preferably an additional plastic or polymeric layer 318 divides the outer surface 316 from the weight material 312.

FIGS. 33 *a-e* illustrates a method for assembling the weight of the present invention. Initially, the inner wall fabric is sewn together 400. A polymer bag supporting a weight such as steel or a loose or flowable material is then inserted into the fabric 402. A rubber coated retainer 404 is then applied. Cross straps 408 are then applied for stability. A foam 406 is then applied to prevent wear and ripping of the inner wall fabric 400. Additional outer layers are then applied. These are a layer of fabric 410 covered by a foam layer 412 and then encapsulated by an extra fabric layer 414. The outer wall fabric slips over the inner wall retainer and weights 415. The unit is then stitched together 416.

In a further modification, the embodiment includes a flexible seam comprising SPANDEX (elastic synthetic fiber) or NEOPRENE (synthetic rubber) or similar material. The flexible seam will expand when bigger barrel bats are entered into the bat swing weight and the seam will contract when smaller bats are entered into the bat swing weight to fit snugly to different size barrels. The flexible seam can be any shape and size. Alternatively, the inner wall of the bat swing weight could comprise a flexible material, instead of the inclusion of a flexible seam.

Figure 34A:
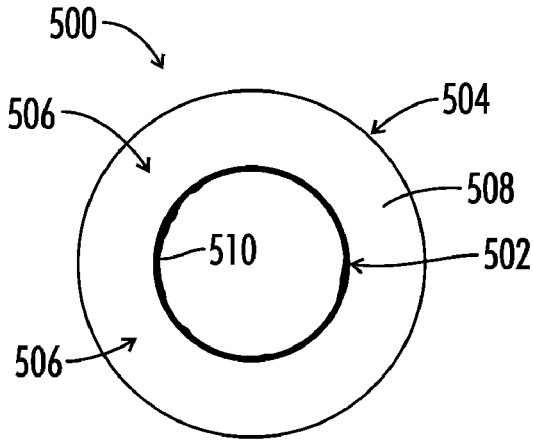
FIG. 34 illustrates the present invention including the addition of soft donut shaped weights.
Figure 34B:
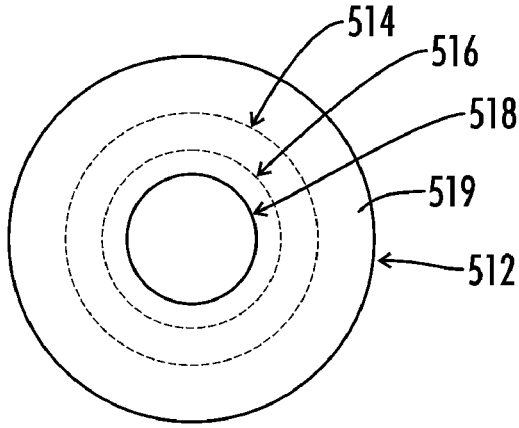
Figure 34C:
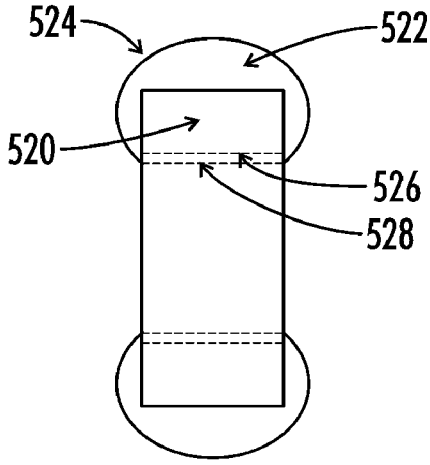

Referring now to FIGS. 34*a* to 34*c*, directed to still additional embodiments where the invention comprises a donut-shaped weight 500. As shown in FIG. 34*a*, the invention comprises a donut-shaped weight having an inner fabric 502, outer fabric 504 and weighted filler 506, which may comprise a flexible material 508. A rigid inner band 510 maintains the rigidity of the donut.

FIG. 34*b* illustrates another donut shaped embodiment, having an outer fabric wall 512, outer donut 514, inner donut 516 and inner fabric wall 518. This embodiment includes a filler material 519.

FIG. 34*c* is a section view of another donut shaped embodiment showing a rubber or vinyl coated metallic donut 520 encased or covered in soft fabric 522 and/or including a foam 524. An inner wall 526 and fabric 528 is shown.

While the present invention has been described in the context of the above discussed preferred embodiment, it is to be appreciated that other embodiments fulfill the spirit and scope of the present invention and that the true nature and scope of the present invention is to be determined with reference to the claims appended hereto.

The invention claimed is:

1. A bat weight for use on a bat having a knob end, a barrel end opposite the knob end and a taper defined along an outer surface between the knob end and the barrel end, a cross-section the bat weight comprising:

a) a longitudinal axis, a first opening at a first end, and a second opening at a second end opposite the first end, the second opening being larger than the first opening;

b) a weighted section defined between the first end and the second end, a portion of which further comprising in cross-section:
i) a first layer of material;
ii) a weight;
iii) a second layer of material;
iv) a foam layer; and
v) a third layer of material;

c) an annular retainer ring secured proximate the first end for engaging the bat taper upon advancement of the bat weight across the bat outer surface from the knob end to the barrel end, the annular retainer ring fixing the dimension of the first opening during use and non-use of the bat weight relative to a bat such that the first opening is not adjustable relative to the bat during use an non-use of the bat weight relative to a bat;

d) the weighted section spaced from the annular retainer ring and defined between the annular retainer ring and the second end and further comprising a plurality of separate, spaced apart weights secured around the longitudinal axis; and e) wherein centrifugal force during swinging of the bat seats the annular retainer ring against the bat taper.

2. The bat weight of claim 1, wherein the plurality of separate, spaced-apart weights are secured within discrete pockets.

3. The bat weight of claim 1, wherein the plurality of spaced-apart weights are deformable.

4. The bat weight of claim 1, wherein the weighted section is spaced from the second end such that the second end is axially deformable relative to the weighted section.

5. A bat weight for use on a bat having a knob end, a barrel end opposite the knob end and a taper defined along an outer surface between the knob end and the barrel end, the bat weight comprising:

a) a longitudinal axis, a first opening at a first end, a second opening at a second end opposite the first end;

b) a circumferential inner wall of flexible, expandable material defined along the longitudinal axis between the first and second ends for positioning adjacent the bat outer surface;

c) a weighted section defined by a plurality of separated, spaced apart weights arranged around the circumferential inner wall;

d) an outer surface defined over each weight for assisting in the gripping and positioning of the bat weight relative to the bat; and e) a non-adjustable retainer ring secured proximate the first end for engaging the bat taper upon sliding advancement of the tubular sleeve across the bat outer surface from the knob end to the barrel end, the retainer ring spaced from the weights along the longitudinal axis of the bat weight, the retainer ring being non-adjustable during use and non-use of the bat weight relative to a bat;

f) wherein centrifugal force during swinging of the bat seats the retainer against the bat taper; and g) wherein the weighted section is spaced from the second end such that the second end is axially deformable relative to the weighted section.

6. The bat weight of claim 5, wherein the plurality of separate, spaced-apart weights are secured within discrete pockets.

7. The bat weight of claim 5, wherein the plurality of spaced-apart weights are deformable.

8. The bat weight of claim 6, wherein the flexible, expandable material is elastic synthetic fiber or synthetic rubber.

9. The bat weight of claim 7, wherein the flexible, expandable material is elastic synthetic fiber or synthetic rubber.

10. A bat weight for use on a bat having a knob end, a barrel end opposite the knob end and a taper defined along an outer surface between the knob end and the barrel end, the bat weight comprising:

a) an elongated tubular sleeve comprising a longitudinal axis, a first opening at a first end, a second opening at a second end opposite the first end;

b) a circumferential inner wall defined along the longitudinal axis between the first and second ends for positioning adjacent the bat outer surface;

c) a circumferential outer wall defined along the longitudinal axis between the first and second ends for assisting in the gripping and positioning of the sleeve relative to the bat;

d) a layer of foam defined between the circumferential inner wall and the circumferential outer wall;

e) a non-adjustable retainer ring secured between the circumferential inner wall and the circumferential outer wall proximate the first end for engaging the bat taper upon sliding advancement of the tubular sleeve across the bat outer surface from the knob end to the barrel end, the retainer ring being non-adjustable during use and non-use of the bat weight relative to a bat; and f) a plurality of separated, spaced apart weights arranged around the circumferential inner wall and spaced from the retainer ring;

g) wherein centrifugal force during swinging of the bat seats the retainer ring against the bat taper.

11. The bat weight of claim 10, wherein the layer of foam is further defined between the plurality of separated, spaced apart weights and the circumferential outer wall.

12. The bat weight of claim 10, wherein the plurality of separated, spaced-apart weights are secured within discrete pockets.

13. The bat weight of claim 10, wherein the plurality of spaced-apart weights are deformable.

14. The bat weight of claim 10, wherein the retainer ring is axially spaced from the first end in the direction of the second end by a distance greater than the thickness of the retainer ring.

15. The bat weight of claim 14, wherein the first end is axially deformable relative to the retainer ring.

16. The bat weight of claim 10, wherein the first end is axially deformable relative to the retainer.

17. The bat weight of claim 10, wherein the weighted section is spaced from the second end such that the second end is axially deformable relative to the weighted section.

* * * * *